US005590797A

United States Patent [19]

Duffy et al.

[11] Patent Number: 5,590,797

[45] Date of Patent: Jan. 7, 1997

[54] FRICTION CLUTCH MECHANISM FOR HIGH CAPACITY DRAFT GEAR ASSEMBLY AND METHOD OF RECONDITIONING DRAFT GEAR WITH SUCH FRICTION CLUTCH MECHANISM

[75] Inventors: James L. Duffy, Burr Ridge; David W. Daugherty, Jr., Bolingbrook; Wajih Kanjo, Lockport; Rudi E. George, Forest Park, all of Ill.

[73] Assignee: Westinghouse Air Brake Company, Wilmerding, Pa.

[21] Appl. No.: 438,499

[22] Filed: May 10, 1995

[51] Int. Cl.[6] ..... B01G 9/18

[52] U.S. Cl. ..... 213/33

[58] Field of Search ..... 213/33, 32 R, 213/22, 32 B, 32 C

[56] References Cited

U.S. PATENT DOCUMENTS

| | | | |
|---|---|---|---|
| 2,916,163 | 12/1959 | Campbell . | |
| 3,178,036 | 4/1965 | Cardwell . | |
| 3,386,597 | 6/1968 | Willison et al. | 213/32 R |
| 4,591,059 | 5/1986 | Hammarlund | 213/32 R |
| 4,645,187 | 2/1987 | Kanjo et al. | 213/33 X |
| 4,809,419 | 3/1989 | Loonam . | |
| 4,960,215 | 10/1990 | Carlstedt | 213/32 R X |
| 5,152,409 | 10/1992 | Sommerfeld | 213/33 X |
| 5,443,170 | 8/1995 | Merker, Jr. et al. | 213/32 R X |

*Primary Examiner*—S. Joseph Morano
*Attorney, Agent, or Firm*—James Ray & Associates

[57] ABSTRACT

A friction clutch for a draft gear assembly includes two outer stationary plates having outer surfaces engageable with the inner surfaces of a gear housing. A slot formed in each outer stationary plate receives a lubricating insert to prevent clutch sticking after closure and during a release of such gear. A pair of movable plates have outer surfaces frictionally engaged with inner surfaces of such outer stationary plates for absorbing energy during closure of such gear. A pair of inner stationary plates have outer surfaces frictionally engaged with inner surfaces of such pair of movable plates for absorbing energy during such closure. An inner surface of each inner stationary plate is tapered. Another slot formed in each tapered stationary plate adjacent an outer surface receives another lubricating insert which prevents clutch sticking during release of the gear. A pair of wedge shoes having a tapered outer surface frictionally engage an inner surface of such tapered stationary plates for absorbing energy during closure. An upper surface of the wedge shoe is tapered at an angle of between 46.5 and 48.5 degrees and a bottom surface of the wedge shoe is tapered at an angle of between 21.0 and 22.00 degrees. Another slot formed in each wedge shoe adjacent its outer surface has another lubricating insert to prevent clutch sticking during release of the gear. A center wedge having corresponding tapered surfaces frictionally engages an upper surface of a respective one of such pair of wedge shoes for absorbing energy during closure.

16 Claims, 6 Drawing Sheets

FRICTION CLUTCH MECHANISM FOR HIGH CAPACITY DRAFT GEAR ASSEMBLY AND METHOD OF RECONDITIONING DRAFT GEAR WITH SUCH FRICTION CLUTCH MECHANISM

FIELD OF THE INVENTION

The present invention relates, in general, to friction-type draft gear assemblies used on railway cars to provide slack and to absorb shock loads encountered by such railway cars and, more particularly, this invention relates to a friction clutch mechanism which can be used in both the reconditioning and upgrading of a used draft gear assembly in a manner such that the draft gear assembly which has been reconditioned using such friction clutch mechanism will exhibit a higher capacity rating and which can also be used in a new friction-type draft gear assembly, also exhibiting a much higher capacity rating, for absorbing at least a portion of either buff or draft loads which are normally encountered by the center sill member of such railway car during both the make-up of a train consist and the normal in-track movement of such train consist.

BACKGROUND OF THE INVENTION

Draft gear assemblies which utilize friction-type clutch mechanisms to absorb heat energy generated during service have been in widespread use on railway cars for several years prior to the present invention, as is generally well known in the railway art. These draft gear assemblies are disposed within an elongated opening located in the center sill member of the railway car along the longitudinal axis thereof and behind the shank, or innermost end, of the railway car's coupling mechanism. In this position, these friction clutch type draft gear assemblies will absorb at least a relatively large portion of both the buff and draft forces generated during service. Such buff and draft forces encountered by such railway car are usually being applied in an alternating manner to the center sill member during normal car operation on the track.

A representative teaching of such prior art type friction clutch draft gear assemblies can be found, for example, in U.S. Pat. Nos. 2,916,163; 3,178,036; 3,447,693; 4,576,295; 4,645,187 and 4,735,328. Most, if not all, of these prior art type draft gear assemblies either have been or still are being utilized in the railway industry prior to the development of the present invention. Furthermore, except for U.S. Pat. Nos. 4,576,295 and 4,735,328, each of the remaining above-identified patents is owned by the assignee of the present invention. The teachings of each of the above-referenced patents are incorporated herein by reference thereto.

It is quite well recognized, by those persons who are skilled in the friction clutch type draft gear assembly design art, that these draft gear assemblies must be provided with the capability of maintaining at least a certain minimum shock absorbing capacity both during making up a train consist and in-track service. Such minimum capacity has been specified by the Association of American Railroads (AAR) and is defined in the standards issued by the AAR. For example, friction clutch type draft gear assemblies have a specified absolute minimum capacity rating of at least 36,000 foot pounds. Any draft gear assembly with a capacity rating which is determined to be below 36,000 pounds will not receive approval from the AAR for service on any railroad car which may be used in interchange.

It is, likewise, important to note that the heat energy absorbing action of the friction clutch mechanism must enable this minimum capacity rating to be readily achieved without exceeding a specified maximum 500,000 pound reaction force, or pressure, being exerted on the center sill member of the railway car during both such make-up and operation of such train consist. It has been found that such maximum reaction pressure is required to enable these high energy shocks to be readily absorbed without upsetting the end of the coupling member shank and/or damaging other critical car components and/or the lading that is being transported by such railway car.

In order for the manufacturers of such friction clutch type draft gear assemblies to meet the requirements of the railroad industry, with the ever increasing load carrying capacity of their modern day railroad cars, it has become of extreme importance to enhance the overall rated capacity of the friction-type draft gear assemblies as much as possible. This higher capacity rating being found necessary in order to minimize any damage to such cars and/or the lading due to the increased forces being exerted on the center sill member of the cars by the heavier loads such cars are now carrying.

SUMMARY OF THE INVENTION

In a first aspect, the present invention provides an improved friction clutch mechanism for use in a friction clutch type draft gear assembly which will provide an enhanced capacity rating for such draft gear assembly. The invented friction clutch mechanism includes a pair of outer stationary plate members. An outermost surface of each outer stationary plate member is engageable with a respective radially opposed portion of an inner surface of a draft gear housing member adjacent an open end of such housing member. A first elongated slot is formed at a predetermined location in each of such outer stationary plate members adjacent an inner surface thereof. Received within such first elongated slot is a preselected first lubricating insert member. The first lubricating insert member provides a first portion of a requisite amount of the lubrication found necessary in order to prevent any detrimental sticking of such friction clutch mechanism after closure of the draft gear assembly and during a release cycle thereof. The friction clutch mechanism, of the present invention, also includes a pair of movable plate members. Each of these movable plate members will have an outer surface thereof frictionally engaged with a respective inner surface of such pair of outer stationary plate members. Such respective frictionally engaged surfaces will absorb a first portion of the heat energy which is generated during closure of the draft gear assembly. In addition, there are a pair of inner stationary plate members provided. Each one of the inner stationary plate members has an outer surface thereof positioned to frictionally engaged with a respective inner surface of such pair of movable plate members. These respective frictionally engaged surfaces absorb a second portion of such heat energy which is being generated during such closure of the draft gear assembly. An inner surface of each of such inner stationary plate members is tapered at a first predetermined angle. A second elongated slot is formed at a predetermined location in each of such tapered stationary plate members adjacent an outer surface thereof. Disposed within this second elongated slot is a preselected second lubricating insert member which provides a second portion of the requisite amount of lubrication discovered to be necessary in order to prevent the detrimental sticking of such friction clutch mechanism after such closure of the draft gear assembly and during such release cycle thereof. The improved friction clutch mechanism further includes a pair of specially designed wedge shoe members. Each of such wedge shoe members includes a tapered outer surface which is positioned to frictionally engage with a respective inner surface of the tapered stationary plate members for absorbing a third portion of such heat energy generated during closure of such draft gear assembly. An upper surface of each wedge shoe member is tapered downwardly from a point which is located inwardly from the tapered outer surface of the wedge shoe member and inwardly toward and at an acute angle relative to a longitudinal centerline of such friction clutch mechanism. The tapered upper surface is tapered at an angle of between 46.5 degrees and 47.5 degrees. The bottom surface of each wedge shoe member is tapered upwardly from a point disposed inwardly from such tapered outer surface and inwardly toward and at an acute angle relative perpendicularly to the longitudinal centerline of such friction clutch mechanism. The tapered bottom surface is tapered at an angle of between 21.0 degrees and 22.00 degrees. Further, according to the present invention, a third elongated slot is formed at a predetermined location in each of such wedge shoe members adjacent the tapered outer surface thereof for receiving therein a preselected third lubricating insert member which will provide a third portion of such requisite amount of lubrication found necessary to prevent such detrimental sticking of such friction clutch mechanism after closure of such draft gear assembly and during a release cycle thereof. The final essential element of the invented friction clutch mechanism is a center wedge member. In the present invention, such center wedge member will include a pair of correspondingly tapered surfaces frictionally engaged with an upper tapered surface of a respective one of the pair of wedge shoe members for absorbing a fourth portion of such heat energy which is generated during such closure of the draft gear assembly.

The instant invention provides, according to a second aspect thereof, an improved high capacity friction clutch type draft gear assembly for absorbing both the buff and draft loads applied to a center sill member of a railway car during both the make-up of a train consist and the in-track operation of such train consist. Such improved high capacity friction clutch type draft gear assembly, according to the present invention, includes a generally rectangular shaped housing member. Such housing member includes an end wall for closing a first end thereof. The housing member being open at a radially opposed second end thereof. There is at least one compressible cushioning means disposed within the cavity of such housing member adjacent an inner surface of such end wall disposed at the first end of such housing member. The compressible cushioning means being provided to store a first portion of the energy which is generated during closure of the draft gear assembly and then such compressible cushioning means releases this stored energy to assist in restoring such draft gear assembly to an open condition during a release cycle. A friction clutch mechanism is disposed at least partially within the open end of such housing member. The friction clutch mechanism includes a pair of outer stationary plate members. An outer surface of each of such outer stationary plate members is engaged with a respective radially opposed inner surface of such draft gear housing member adjacent the open end of such housing member. A first elongated slot is formed at a predetermined location in each of such outer stationary plate members adjacent an inner surface thereof. Disposed within such first elongated slot is a preselected first lubricating insert member which provides a first portion of a requisite amount of lubrication discovered to be necessary to prevent any undesirable sticking of such friction clutch mechanism after closure of such draft gear assembly and during a release cycle thereof. There is a pair of movable plate members provided. Each of these movable plate members have an outer surface thereof frictionally engaged with a respective inner surface of such pair of outer stationary plate members. Such respective frictionally engaged surfaces absorb a first portion of the heat energy generated during a closure cycle of such draft gear assembly. Additionally, there are a pair of inner stationary plate members. Each of such inner stationary plate members has an outer surface thereof frictionally engaged with a respective inner surface of the pair of movable plate members. These respective frictionally engaged surfaces absorb a second portion of the heat energy generated during such closure of the draft gear assembly. An inner surface of each of such inner stationary plate members is tapered at a first predetermined angle. A second elongated slot is formed at a predetermined location in each of the tapered stationary plate members adjacent an outer surface thereof. A preselected second lubricating insert member is disposed within this second elongated slot to provide a second portion of such requisite amount of lubrication found necessary to prevent such undesirable sticking of such friction clutch mechanism after such closure of the draft gear assembly and during such release cycle thereof. Such friction clutch mechanism further includes a pair of wedge shoe members. Each of the wedge shoe members includes a tapered outer surface which is frictionally engaged with a respective inner surface of the tapered stationary plate members for absorbing a third portion of the heat energy which is generated during such closure of such draft gear assembly. An upper surface of each wedge shoe member is tapered downwardly from a point disposed inwardly from the tapered outer surface and inwardly toward and at an acute angle relative to a longitudinal centerline of such friction clutch mechanism. The tapered upper surface is tapered at an angle of between 46.5 degrees and 47.5 degrees. The bottom surface of each wedge shoe member is tapered upwardly from a point disposed inwardly from the tapered outer surface and inwardly toward and at an acute angle relative perpendicularly to the longitudinal centerline of such friction clutch mechanism. This tapered bottom surface is tapered at an angle of between 21.0 degrees and 22.00 degrees. There is a third elongated slot formed at a predetermined location in each of the wedge shoe members adjacent such tapered outer surface thereof. A preselected third lubricating insert member is disposed within this third elongated slot to provide a third portion of such requisite amount of lubrication found to be necessary to prevent such undesirable sticking of the friction clutch mechanism after such closure of the draft gear assembly and during such release cycle thereof. The last essential element of the friction clutch mechanism is a center wedge member. Such center wedge member includes a pair of correspondingly tapered surfaces which are positioned to frictionally engage an upper tapered surface of a respective one of such pair of wedge shoe members for absorbing a fourth portion of the heat energy generated during such closure of the draft gear assembly. The final essential component of the improved high capacity draft gear assembly, of the present invention, is a spring seat member which is engageable with one end of the compressible cushioning means and with at least a portion of the lower end of the friction clutch mechanism. Such spring seat member is positioned to transmit the longitudinal forces being applied to such compressible cushioning means from the friction clutch mechanism during closure of such draft gear assembly and thereafter from such compressible cushioning means to the friction clutch mechanism during such release cycle of the draft gear assembly, respectively.

According to a third and final important aspect of the present invention, there is provided a method of significantly increasing the capacity rating of a friction clutch type draft gear assembly during a reconditioning of such draft gear assembly. Such method includes the steps of first removing a friction clutch mechanism from an open end of a housing member of such draft gear assembly. Thereafter, engaging a respective outer surface of a pair of outer stationary plate members with a respective radially opposed portion of an inner surface of such housing member adjacent the open end of such housing member. Each of such outer stationary plate members ia provided with a first elongated slot formed on an inner surface thereof at a predetermined location which contains a preselected lubricating insert therein to provide at least a first portion of a requisite amount of lubrication found necessary to prevent the detrimental sticking of such friction clutch mechanism after a closure of such draft gear assembly and during a release cycle thereof. Then, frictionally engaging a respective outer surface of a pair of movable plate members with a respective radially opposed inner surface of such outer stationary plate members. Thereafter, frictionally engaging a respective outer surface of a pair of inner stationary plate members with a respective radially opposed inner surface of the movable plate members. A predetermined taper is provided on an inner surface of each of such pair of inner stationary plate members. Such taper extends upwardly from a bottom surface thereof and outwardly from a longitudinal centerline of such friction clutch type draft gear assembly. Each of such tapered stationary plate members having a second elongated slot formed on an outer surface thereof at a predetermined location which contains a preselected second lubricating insert therein to provide at least a second portion of the requisite amount of lubrication discovered necessary to prevent such detrimental sticking of such friction clutch mechanism after closure of such draft gear assembly and during a release cycle thereof. Thereafter, frictionally engaging a respective outer tapered surface of a pair of wedge shoe members with a respective inner tapered surface of such movable plate members. A tapered upper surface is provided on each of such pair of wedge shoe members. The tapered upper surface tapers downwardly from a point disposed inwardly from such tapered outer surface and inwardly toward and at an acute angle relative to the longitudinal centerline of the draft gear assembly. Such tapered upper surface is tapered at an angle of between 46.5 degrees and 47.5 degrees. A tapered bottom surface is provided on each of such pair of wedge shoe members. Such tapered bottom surface tapers upwardly from a point disposed inwardly from the tapered outer surface of the wedge shoe member and inwardly toward and at an acute angle relative perpendicularly to such longitudinal centerline of the draft gear assembly. Such tapered bottom surface is tapered at an angle of between 21.00 degrees and 22.00 degrees. Each of such wedge shoe members having a third elongated slot formed on the tapered outer surface thereof at a predetermined location which contains a preselected third lubricating insert therein to provide at least a third portion of the requisite amount of lubrication found necessary to prevent such detrimental sticking of such friction clutch mechanism after closure of such draft gear assembly and during a release cycle thereof. Finally, frictionally engaging a pair of tapered surfaces disposed on a center wedge member with a respective tapered upper surface of such pair of wedge shoe members.

OBJECTS OF THE INVENTION

It is, therefore, one of the primary objects of the present invention to provide an improved friction-type clutch mechanism which can be utilized to significantly enhance the capacity rating of a friction-type draft gear assembly to be used on a railway car to absorb buff and draft loads during service.

Another object of the present invention is to provide a higher rated capacity friction clutch type draft gear assembly having such improved friction clutch mechanism incorporated therein.

Still another object of the present invention is to provide an improved friction clutch mechanism that can be readily retrofitted to existing friction clutch type draft gear assemblies at the time of reconditioning such friction clutch type draft gear assembly.

Yet another object of the present invention is to provide an improved friction clutch mechanism which will provide a higher capacity rating to a reconditioned draft gear assembly having such friction clutch mechanism.

A further object of the present invention is to provide an improved friction clutch mechanism which is relatively simple to manufacture.

It is an additional object of the present invention to provide an improved friction clutch mechanism which will provide a draft gear assembly a relatively long service life thereby minimizing repair and maintenance costs to be incurred by the railroads.

Still yet another object of the invention is to provide an improved friction clutch mechanism which is relatively easy to install.

Yet a further object of the present invention is to provide an improved friction clutch mechanism which can be used to recondition a number of different draft gear manufactures draft gear assemblies and provide a higher capacity rated friction clutch type draft gear assembly.

Still a further object of the present invention is to provide a method of reconditioning a friction clutch type draft gear assembly with an improved friction clutch mechanism which will provide such reconditioned draft gear assembly with an enhanced capacity rating.

In addition to the various objects and advantages of the present invention described above, it should be noted that various other objects and advantages of the present invention will become more readily apparent to those persons who are skilled in the railway car friction-type draft gear design art from the following more detailed description of the present invention, particularly, when such description is taken in conjunction with the attached drawing Figures and with the appended claims.

Figure 1:
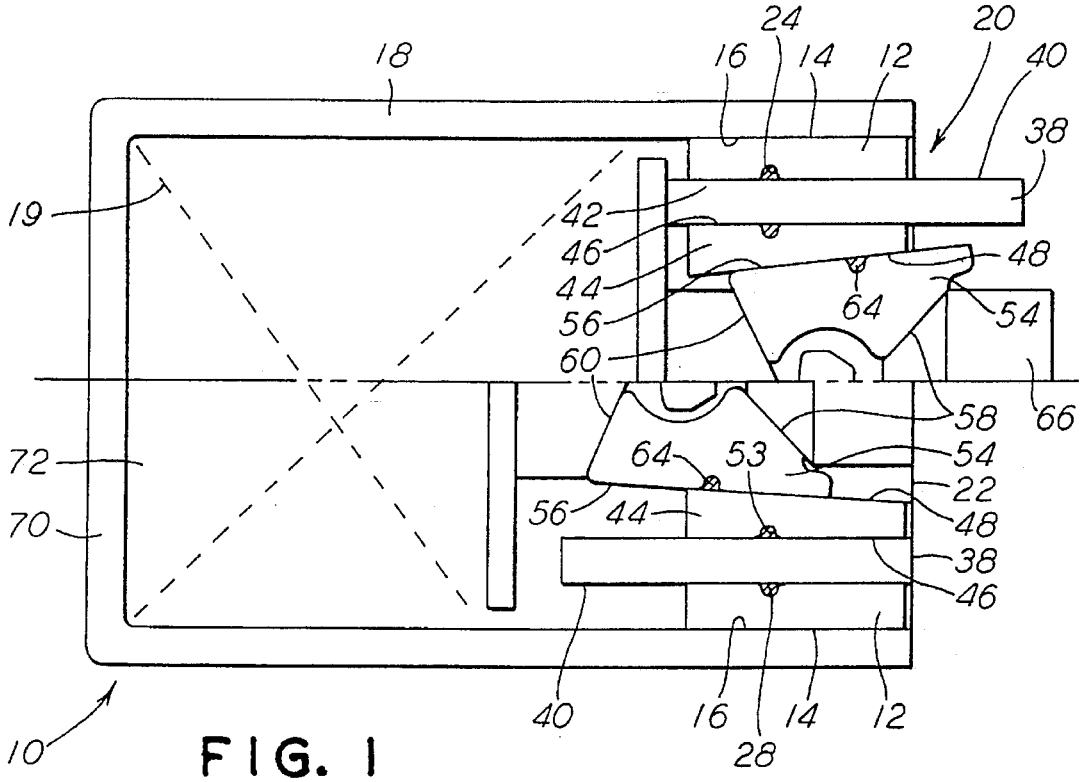
FIG. 1 is layout of a presently preferred embodiment of a high capacity friction clutch type draft gear assembly which is constructed according to a presently preferred embodiment of the invention.
Figure 5:
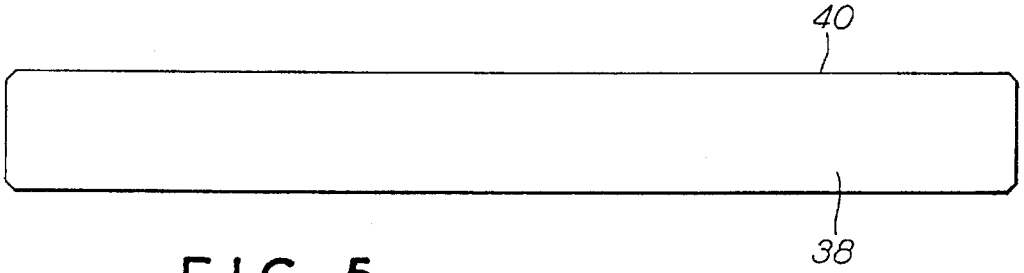
FIG. 5 is a side elevation view of a presently preferred movable plate member of the improved friction clutch mechanism produced according to the present invention.
Figure 6:
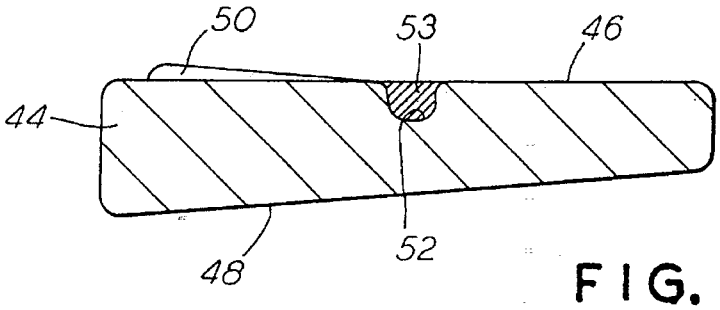
FIG. 6 is a cross sectional view of a presently preferred inner stationary plate member of the improved friction clutch mechanism produced according to the present invention.
Figure 2:
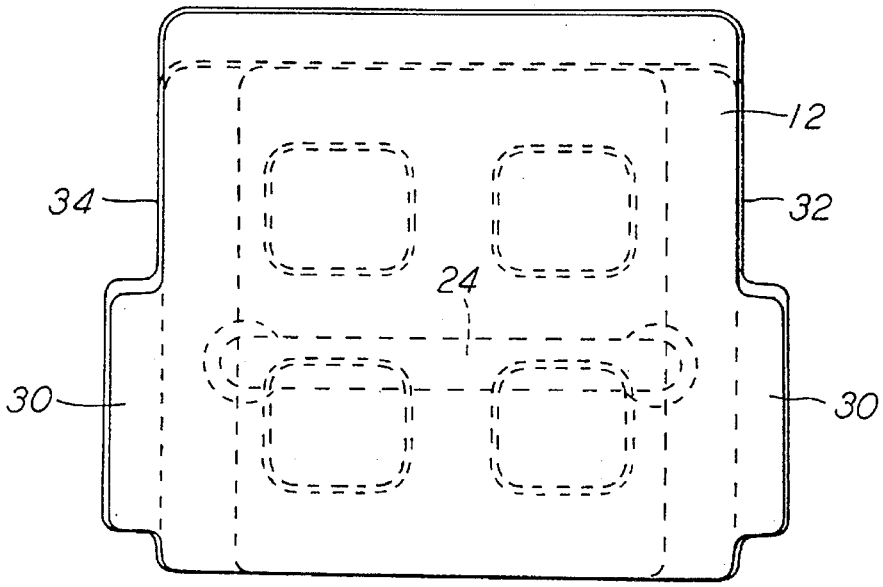
FIG. 2 is a plan view of a presently preferred outer stationary plate member of the improved friction clutch mechanism produced according to the present invention.
Figure 3:
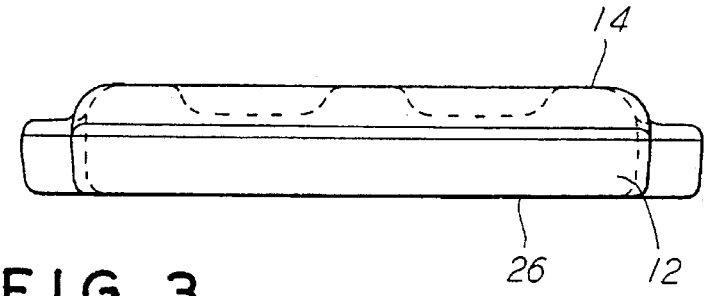
FIG. 3 is a top view of the outer stationary plate member illustrated in FIG. 2.
Figure 4:
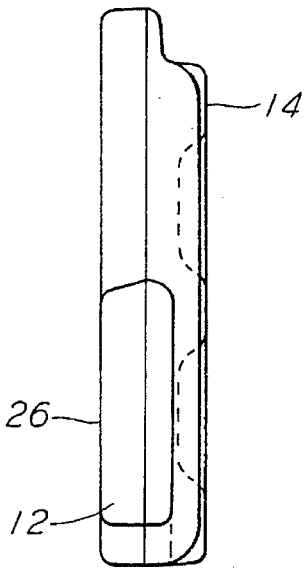
FIG. 4 is a side elevation view of the outer stationary plate member illustrated in FIGS. 2 and 3.
Figure 7:
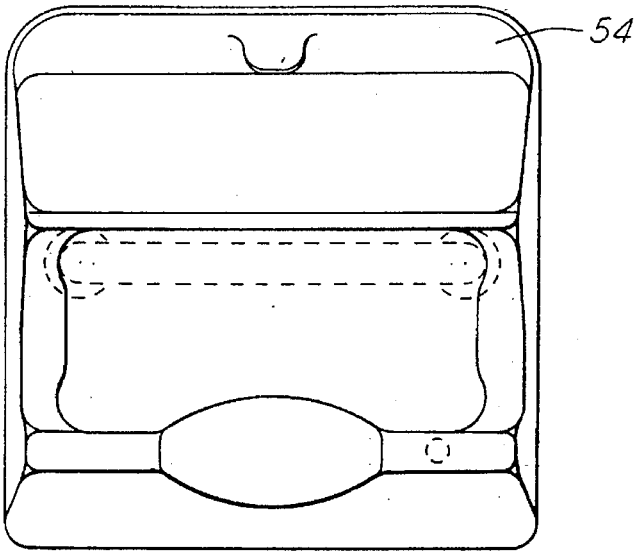
FIG. 7 is a plan view of a presently preferred wedge shoe member of the improved friction clutch mechanism produced according to the present invention.
Figure 8:
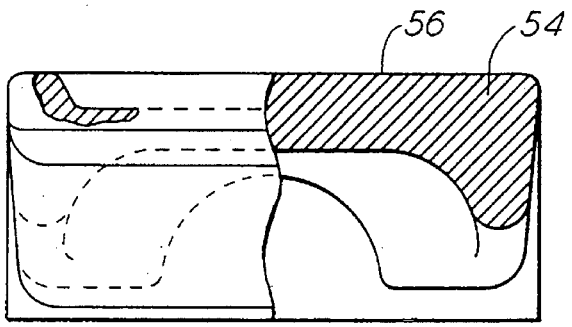
FIG. 8 is a top view of the wedge shoe member illustrated in FIG. 7.
Figure 9:
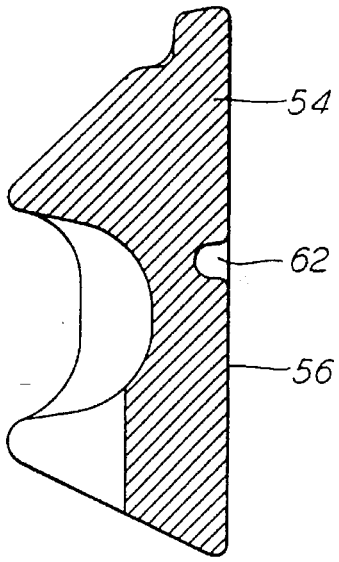
FIG. 9 is a side elevation view of the wedge shoe member illustrated in FIGS. 7 and 8.
Figure 10:
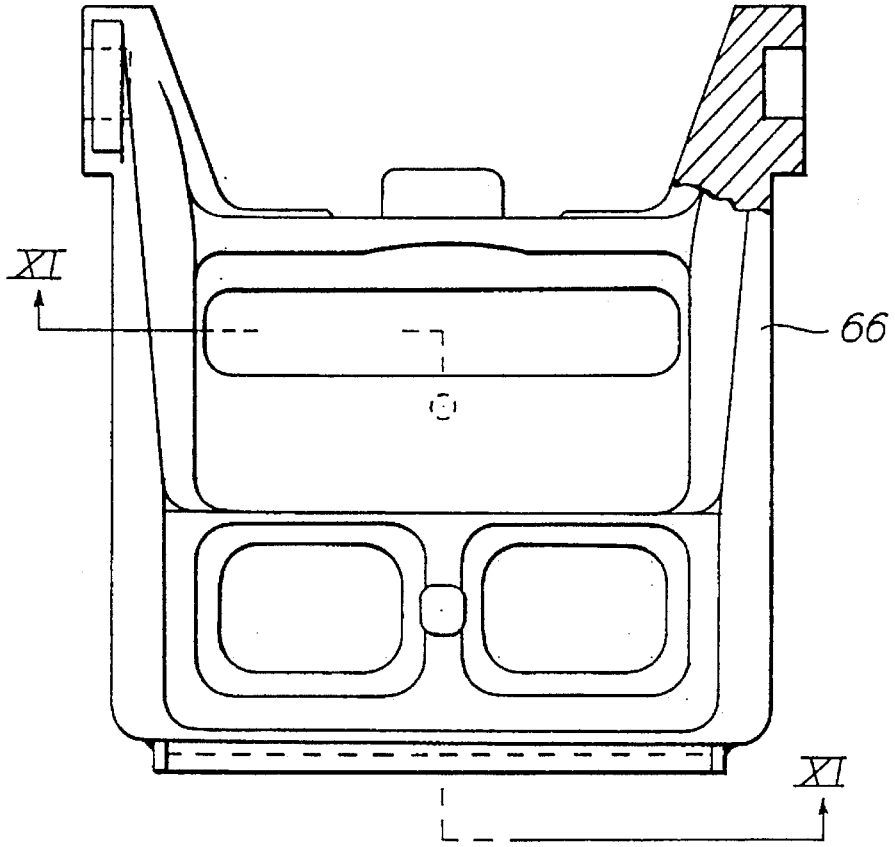
FIG. 10 is a plan view of a presently preferred center wedge member of the improved friction clutch mechanism produced according to the present invention.
Figure 11:
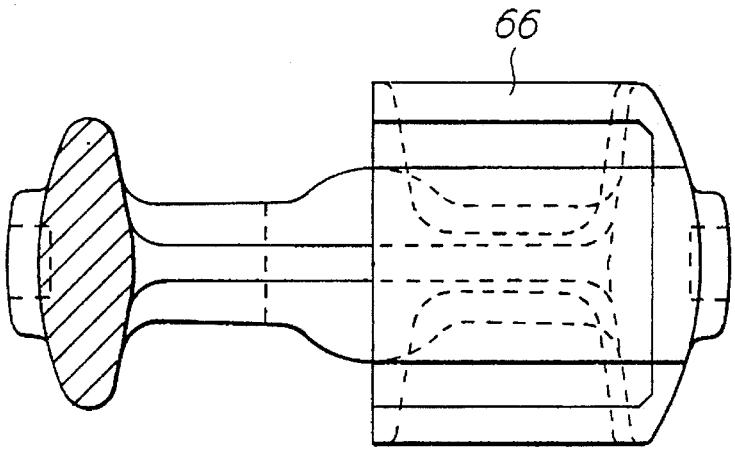
FIG. 11 is a view which is taken along the lines XI—XI of FIG. 10.
Figure 12:
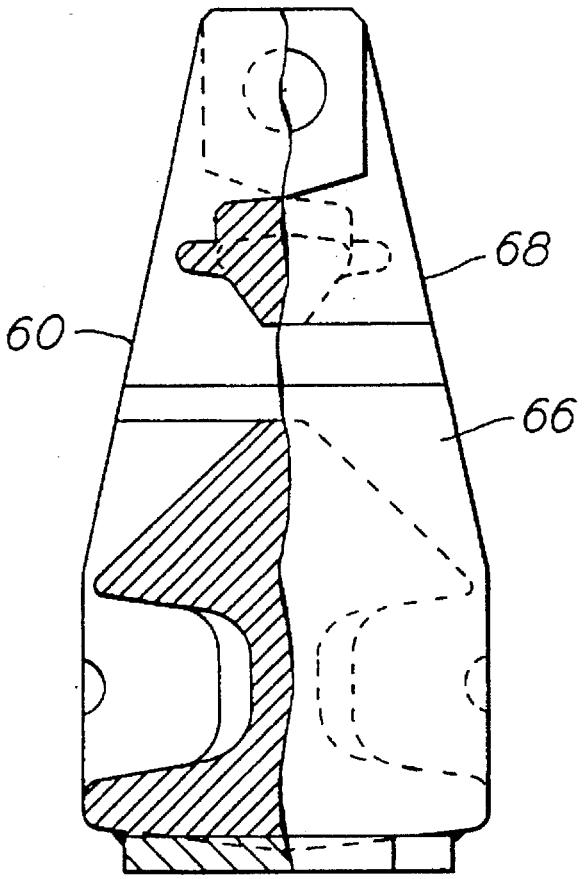
FIG. 12 is a side elevation view, which is partially in cross-section, of the center wedge member illustrated in FIGS. 10 and 11.

BRIEF DESCRIPTION OF THE PRESENTLY PREFERRED AND ALTERNATIVE EMBODIMENTS OF THE INVENTION

Prior to proceeding to the more detailed description of the various embodiments of the instant invention, it should be pointed out that, for the sake of clarity, identical components which have identical functions have been identified with identical reference numerals throughout the several views that have been illustrated in the drawings.

Now reference is made, more particularly, to drawing FIGS. 1 through 12. Illustrated therein are the essential components of an improved friction clutch mechanism, generally designated 20, for absorbing heat energy in a friction-type draft gear assembly, generally designated 10, used in a railway car (not shown). This heat energy, as is quite well known in the art, is always generated during the make-up of a train consist and during the movements of such train consist over a track structure.

Such friction clutch mechanism 20 includes, in the presently preferred embodiment of the invention, a pair of outer stationary plate members 12. A respective outer surface 14 of each of such outer stationary plate members 12 is engageable with a respective radially opposed portion of an inner surface 16 of a draft gear assembly 10 housing member 18 adjacent an open end 22 of such housing member 18.

There is a first elongated slot 24 formed at a predetermined location in each of such outer stationary plate members 12 adjacent an inner surface 26 thereof. Additionally, each outer stationary plate member 12 includes a preselected first lubricating insert member 28 disposed within such first elongated slot 24. The lubricating insert member 28 provides at least a first portion of a requisite amount of lubrication which was discovered to be necessary to prevent the detrimental sticking of such friction clutch mechanism 20 after closure of such draft gear assembly 10 and during a release cycle thereof. Sticking of such friction clutch mechanism 20 will result in the friction clutch type draft gear assembly 10 malfunctioning which can become a severe operating problem.

Each of the outer stationary plate members 12 is further provided with a pair of lug members 30. Such lug members 30 prevent any longitudinal movement of such outer stationary plate members 12 during operation of the draft gear assembly 10. Such lug members 30 are formed on radially opposed edges 32 and 34 of the outer stationary plate member 12.

In the presently preferred embodiment of the invention, it has been found to be critical that each such outer stationary plate member 12 exhibit a Brinell hardness of between 429 and 495 in order to achieve the desired higher capacity rating and for achieving an optimum performance of the draft gear assembly 10.

Also in this presently preferred embodiment, the first elongated slot 24 will have a generally arcuate shape in a plane disposed substantially at a right angle to the longitudinal axis of such first elongated slot 24. The first lubricating insert member 28 is formed from a lubricating metal, which is preferably a brass alloy.

In a presently preferred embodiment, the friction clutch mechanism 20, of the present invention, further includes a pair of movable plate members 38. At least a predetermined portion of an outer surface 40, of each of such movable plate members 38 frictionally engages with a respective inner surface 42 of such pair of outer stationary plate members 12 for absorbing at least a first portion of the heat energy which is generated during closure of such friction clutch mechanism 20 portion of such draft gear assembly 10. Additionally, in this embodiment of such friction clutch mechanism 20, each of the movable plate members 38 will be generally rectangular in shape and the outer surface 40 will be disposed substantially parallel to the inner surface 42.

A pair of tapered stationary plate members 44 are, also, one of the essential components of the presently preferred friction clutch mechanism 20 of the instant invention. Each of such tapered stationary plate members 44 includes an outer surface 46, disposed substantially parallel to the longitudinal centerline of such friction clutch mechanism 20. Such outer surface 46 is positioned to be frictionally engaged with a respective inner surface 42 of such pair of movable plate members 38.

These frictionally engaged surfaces absorb at least a second portion of the heat energy which is generated during such closure of friction clutch mechanism 20 of such friction clutch type draft gear assembly 10. The inner surface 48 of each of such tapered stationary plate members 44 is tapered at a first predetermined angle.

Wing members 50 are provided on each tapered stationary plate member 44 to serve as a longitudinal guide for the movable plate members 38 during closure and release of the friction clutch type draft gear assembly 10. A pair of lug members (not shown), which are similar to the lug members 30 on the outer stationary plate members 12, are provided on each outer edge of each such tapered stationary plate member 44 to prevent any longitudinal movement of the tapered stationary plate members 44 during closure and release of such friction clutch type draft gear assembly 10.

There is a second elongated slot 52 formed, at a predetermined location, in each of such tapered stationary plate members 44 adjacent the outer surface 46 thereof. Like the first slot 24, which is formed in the outer stationary plate members 12, such second elongated slot 52, preferably, has a generally arcuate shape in a plane disposed at substantially right angles to the longitudinal axis of this second elongated slot 52.

Further, according to the instant invention, there is a second preselected lubricating insert member 53 which is disposed within such second elongated slot 52. This second lubricating insert member 53 provides at least a second portion of the previously mentioned requisite amount of lubrication which was discovered to be necessary in order to prevent such detrimental sticking of such friction clutch mechanism 20 after closure of such friction clutch type draft gear assembly 10 and during the release cycle thereof.

Another essential component of the improved friction clutch mechanism 20, according to a presently preferred embodiment of the present invention, is a pair of wedge shoe members 54. Each of such wedge shoe members 54 includes a tapered outer surface 56. This outer surface 56 is positioned to be frictionally engaged with a respective inner surface 48 of a respective one of such tapered stationary plate members 44. Engaged surfaces 48 and 56 absorb at least a third portion of the heat energy generated during closure of such friction clutch mechanism 20 portion of such friction clutch type draft gear assembly 10.

The upper surface 58 of each wedge shoe member 54 is tapered downwardly from a point disposed inwardly from such tapered outer surface 56 and inwardly toward and at an acute angle relative to the longitudinal centerline of such friction clutch mechanism 20. It has been found to be absolutely critical, in order for the friction clutch mechanism 20 to provide a significant increase in rated capacity, that the tapered upper surface 58 must be tapered at an angle of between 46.5 degrees and 48.5 degrees. Preferably, to achieve an optimum capacity rating this angle will be controlled as close as possibly to be about 47.5 degrees.

Each of the wedge shoe members 54 include a bottom surface 60 which is tapered upwardly from a point disposed inwardly from such tapered outer surface 56 and inwardly toward and at an acute angle relative perpendicularly to the longitudinal centerline of such friction clutch mechanism 20. It is presently preferred that the tapered bottom surface 60 be tapered at an angle of between 21.0 degrees and 22.00 degrees. Preferably, this angle will be controlled as close as possibly to be at about 21.5 degrees.

There is a third elongated slot 62 formed, at a predetermined location, in each of such wedge shoe members 54 adjacent the outer surface 56 thereof. Like the first elongated slot 24, which is formed in the outer stationary plate members 12, such third elongated slot 62, preferably, has a generally arcuate shape in a plane disposed at substantially right angles to the longitudinal axis of this third elongated slot 62.

Further, there is a third preselected lubricating insert member 64 disposed within the third elongated slot 62. Such third lubricating insert member 64 provides at least a third portion of the requisite amount of lubrication discovered to be absolutely necessary in order to prevent detrimental sticking of such friction clutch mechanism 20 after closure of such friction clutch type draft gear assembly 10 and during the release cycle thereof. It is also preferred that each of the surfaces 56, 58 and 60, of the wedge shoe members 54, which are exposed to wear have a Brinell hardness of between 429 and 495.

The final essential element of the improved friction clutch mechanism 20, according to the presently preferred embodiment of the invention, is a center wedge member 66. Such center wedge member 66 includes a pair of correspondingly tapered surfaces 68. Such tapered surfaces 68 are disposed to frictionally engage the upper tapered surfaces 58 of a respective one of such pair of wedge shoe members 54. The frictionally engaged surfaces 68 and 58 absorb at least a fourth portion of the heat energy generated during a closure of such friction clutch mechanism 20 of such friction clutch type draft gear assembly 10.

The present invention, in a second aspect thereof, provides an improved higher capacity rated friction clutch type draft gear assembly 10 for absorbing both the buff and draft loads which are applied to a center sill member (not shown) of a railway car (not shown) during the make-up of a train consist and the in-track operation of such train consist.

In the presently preferred embodiment, such friction clutch type draft gear assembly 10 includes a generally rectangular shaped housing member 18 having an end wall 70 for closing a first end thereof. Such housing member 18 being open at a radially opposed second end 22 thereof.

A compressible cushioning means 19 is disposed within a cavity 17 of such housing member 18 adjacent an inner surface 72 of such end wall 70. As shown in the U.S. patents incorporated by reference, such a compressible cushioning means 19 are well known in the art and normally comprise a plurality of springs in a variety of different arrangements, or coil springs in combination with one or more resilient members such as a compressible rubber body, or even one or more hydraulic members.

The compressible cushioning means 19 stores at least a portion of energy generated during a compressive force being applied to such friction clutch type draft gear assembly 10 and then releases the stored energy to restore the friction clutch type draft gear assembly 10 toward an open condition when such compressive force is either reduced or completely removed.

There is a friction clutch mechanism 20 disposed at least partially within such open end 22 of the housing member 18. The details of this friction clutch mechanism 20 have been described in detail above and, for the sake of brevity, such detailed description shall not be repeated here. It should be noted, however, that in order to achieve the higher capacity rating of the friction clutch type draft gear assembly 10 it is absolutely critical that the angles and hardnesses taught must be adhered to in assembling the new friction clutch type draft gear assembly 10.

Figure 13:
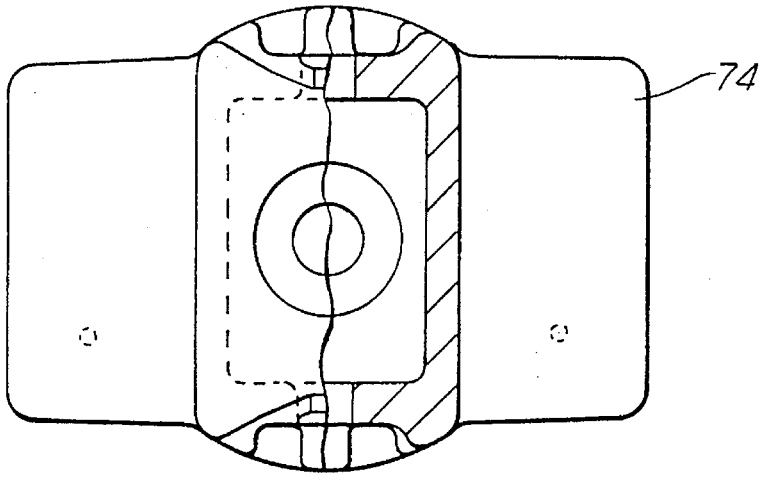
FIG. 13 is a top view of a presently preferred spring seat member, partially in cross-section, for use in the presently preferred embodiment of a high capacity draft gear assembly constructed according to the present invention.
Figure 14:
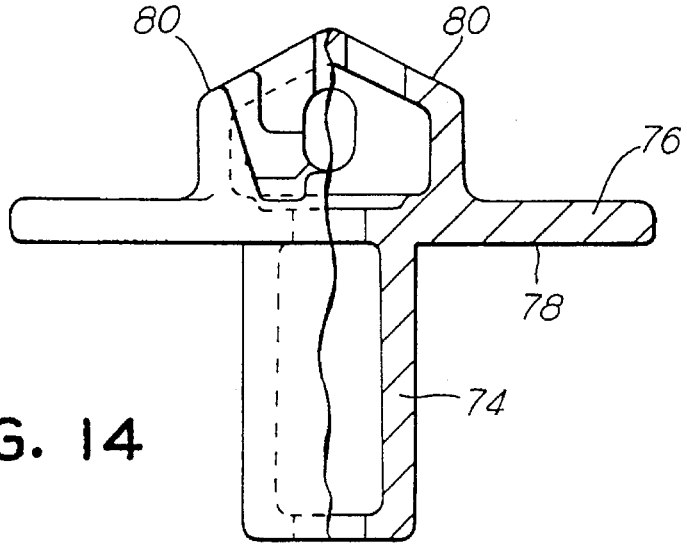
FIG. 14 is a side elevation view, which is partially in cross-section, of the spring seat member illustrated in FIG. 13.
Figure 15:
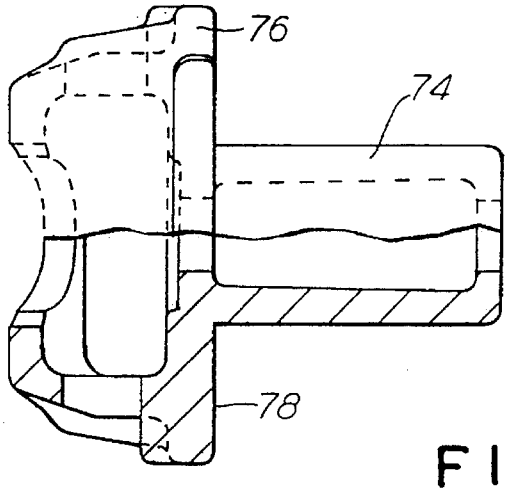
FIG. 15 is an end view, which is partially in cross-section, of the spring seat member illustrated in FIGS. 13 and 14.

Another essential element of the friction clutch type draft gear assembly 10, according to a presently preferred embodiment and which is best seen in FIGS. 13, 14 and 15, is a spring seat member 74. Such spring seat member 74, as illustrated, includes a plate-like member 76 having a bottom surface 78 engageable with one end of such compressible cushioning means 19 and a pair of tapered surfaces 80 which are engageable with the bottom surfaces 60 of such wedge shoe members 54 of such friction clutch mechanism 20.

The spring seat member 74 transmits longitudinal forces to such compressible cushioning means 19 from the friction clutch mechanism 20 during closure of such friction clutch type draft gear assembly 10 and from the compressible cushioning means 19 to the friction clutch mechanism 20 during such release cycle of the friction clutch type draft gear assembly 10, respectively.

The instant invention also contemplates and provides both a method of and a means for increasing the capacity rating of an existing friction clutch type draft gear assembly during a reconditioning being carried out on such friction clutch type draft gear assembly.

Such reconditioning and upgrading of an existing draft gear assembly in order to achieve a significantly higher capacity rating first includes the step of removing a friction clutch mechanism from an open end of a housing member of such draft gear assembly. Then engaging a respective outer surface of a pair of outer stationary plate members with respective radially opposed portions of an inner surface of the housing member adjacent the open end of such housing member.

Thereafter, frictionally engaging a respective outer surface of a pair of movable plate members with a respective radially opposed inner surface of such outer stationary plate members. Next, frictionally engaging a respective outer surface of a pair of inner stationary plate members with a respective radially opposed inner surface of such movable plate members. A predetermined taper has been provided on an inner surface of each of such pair of inner stationary plate members. Such taper extending upwardly from a bottom surface thereof and outwardly from a longitudinal centerline of such draft gear assembly.

A respective outer tapered surface of a pair of wedge shoe members is then frictionally engaged with a respective inner tapered surface of the tapered stationary plate members. A tapered upper surface is provided on each of the pair of wedge shoe members. This tapered upper surface tapering downwardly from a point disposed inwardly from such tapered outer surface and inwardly toward and at an acute angle relative to the longitudinal centerline of the draft gear assembly. It has been found to be absolutely critical that this tapered upper surface be tapered at an angle of between 46.5 degrees and 48.5 degrees in order to achieve the higher capacity rating.

Also, a tapered bottom surface is provided on each of such pair of wedge shoe members. Such tapered bottom surface tapering upwardly from a point disposed inwardly from such tapered outer surface and inwardly toward and at an angle relative perpendicularly to the longitudinal centerline of such draft gear assembly. It is also important or such tapered bottom surface to be tapered at an angle of between 21.00 degrees and 22.00 degrees.

Finally, the method includes frictionally engaging a pair of tapered surfaces disposed on a center wedge member with a respective tapered upper surface of such pair of wedge shoe members. Preferably, the method will include the additional steps of removing the compressible cushioning means for examination and replacement if necessary, as well as examining the housing member for possible defects prior to installing the improved friction clutch mechanism.

While a number of presently preferred and various alternative embodiments of the instant invention have been described in detail above, various other modifications and adaptations of the present invention may be made by those persons who are skilled in the railway car friction clutch type draft gear art without departing from either the spirit or the scope of the appended claims.

We claim:

1. An improved friction clutch mechanism for enabling a higher capacity rating to be achieved in a friction clutch type draft gear assembly and for absorbing heat energy in such friction clutch type draft gear assembly which heat energy is generated during make-up of a train consist and in-track movement of such train consist, said friction clutch mechanism comprising:

(a) a pair of outer stationary plate members having a Brinell Hardness of between 429 and 495, an outer surface of each of said outer stationary plate members being engageable with a respective radially opposed portion of an inner surface of a draft gear housing member adjacent an open end of such housing member;

(b) a first elongated slot formed at a predetermined location in said each of said outer stationary plate members adjacent an inner surface thereof;

(c) a preselected first lubricating insert member disposed within said elongated slot to provide at least a first portion of a requisite amount of lubrication necessary to prevent detrimental sticking of said friction clutch mechanism after closure of such friction clutch type draft gear assembly and during a release cycle thereof;

(d) a pair of movable plate members, each of said movable plate members having at least a predetermined portion of an outer surface thereof frictionally engaged with a respective said inner surface of said pair of outer stationary plate members for absorbing at least a first portion of such heat energy generated during closure of such friction clutch type draft gear assembly;

(e) a pair of inner stationary plate members, each of said inner stationary plate members having an outer surface thereof frictionally engaged with at least a portion of a respective inner surface of said pair of movable plate members for absorbing at least a second portion of such heat energy generated during such closure of such friction clutch type draft gear assembly, an inner surface of said each of said inner stationary plate members being tapered at a first predetermined angle;

(f) a second elongated slot formed at a predetermined location in said each of said tapered stationary plate members adjacent an outer surface thereof;

(g) a preselected second lubricating insert member disposed within said second elongated slot to provide at least a second portion of a requisite amount of lubrication necessary to prevent such detrimental sticking of said friction clutch mechanism after such closure of such friction clutch type draft gear assembly and during such release cycle thereof;

(h) a pair of wedge shoe members having a Brinell Hardness of between 429 and 495, each of said wedge shoe members including (i) a tapered outer surface frictionally engaged with a respective said inner surface of said tapered stationary plate members for absorbing a third portion of such heat energy generated during such closure of such friction clutch type draft gear assembly, (ii) an upper surface tapered from a point disposed inwardly from said tapered outer surface inwardly toward and at an acute angle relative to a longitudinal axis of said friction clutch mechanism, said tapered upper surface being tapered at an angle of between 46.5 degrees and 48.5 degrees, and (iii) a bottom surface tapered from a point disposed inwardly from said tapered outer surface inwardly toward and at an acute angle relative perpendicularly to said longitudinal axis of said friction clutch mechanism, said tapered bottom surface being tapered at an angle of between 21.0 degrees and 22.00 degrees;

(i) a third elongated slot formed at a predetermined location in said each of said wedge shoe members adjacent said tapered outer surface thereof;

(j) a preselected third lubricating insert member disposed within said third elongated slot to provide at least a third portion of a requisite amount of lubrication necessary to prevent such detrimental sticking of said friction clutch mechanism after closure of such friction clutch type draft gear assembly and during a release cycle thereof; and (k) a center wedge member, said center wedge member including a pair of correspondingly tapered surfaces frictionally engaged with an upper tapered surface of a respective one of said pair of wedge shoe members for absorbing at least a fourth portion of such heat energy generated during such closure of such friction clutch type draft gear assembly.

2. An improved friction clutch mechanism, according to claim 1, wherein said first elongated slot has a generally arcuate shape in a plane disposed substantially at right angles to a longitudinal axis of said first elongated slot.

3. An improved friction clutch mechanism, according to claim 2, wherein said first lubricating insert member is formed from a preselected lubricating metal.

4. An improved friction clutch mechanism, according to claim 3, wherein said preselected lubricating metal is selected from the group consisting of brass and brass alloys.

5. An improved friction clutch mechanism, according to claim 1, wherein said each of said movable plate members is generally rectangular in shape and said outer surface is disposed in a plane substantially parallel to said inner surface.

6. An improved friction clutch mechanism, according to claim 1, wherein said second elongated slot has a generally arcuate shape in a plane disposed substantially at right angles to a longitudinal axis of said second elongated slot.

7. An improved friction clutch mechanism, according to claim 1, wherein said tapered upper surface of said each of said wedge shoe members is tapered at an angle of substantially about 47.5 degrees.

8. An improved friction clutch mechanism, according to claim 7, wherein said tapered bottom surface of said each of said wedge shoe members is tapered at an angle of substantially about 21.5 degrees.

9. An improved high capacity friction clutch type draft gear assembly for absorbing both buff and draft loads being applied to a center sill member of a railway car during make-up of a train consist and in-track operation of such train consist, said friction clutch type draft gear assembly comprising:

(a) a generally rectangular shaped housing member having an end wall for closing a first end thereof, said housing member being open at a radially opposed second end thereof;

(b) a compressible cushioning means disposed within a cavity of said housing member adjacent an inner surface of said end wall disposed at said first end of said housing member for storing at least a first portion of energy generated during closure of said friction clutch type draft gear assembly and releasing stored energy to restore said friction clutch type draft gear assembly to an open condition during a release cycle of said friction clutch type draft gear assembly;

(c) a friction clutch mechanism disposed at least partially within said open end of said housing member, said friction clutch mechanism including (i) a pair of outer stationary plate members having a Brinell Hardness of between 429 and 495, an outer surface of each of said outer stationary plate members being engageable with a respective radially opposed inner surface of said friction clutch type draft gear housing member adjacent said open end of such housing member;

(ii) a first elongated slot formed at a predetermined location in said each of said outer stationary plate members adjacent an inner surface thereof;

(iii) a preselected first lubricating insert member disposed within said first elongated slot to provide at least a first portion of a requisite amount of lubrication necessary to prevent detrimental sticking of said friction clutch mechanism after closure of said draft gear assembly and during a release cycle thereof;

(iv) a pair of movable plate members, each of said movable plate members having at least a predetermined portion an outer surface thereof frictionally engaged with a respective said inner surface of said pair of outer stationary plate members for absorbing at least a first portion of heat energy generated during such closure of said friction clutch type draft gear assembly;

(v) a pair of inner stationary plate members, each of said inner stationary plate members having an outer surface thereof frictionally engaged with at least a portion of a respective inner surface of said pair of movable plate members for absorbing at least a second portion of such heat energy generated during such closure of said friction clutch type draft gear assembly, an inner surface of said each of said inner stationary plate members being tapered at a first predetermined angle;

(vi) a second elongated slot formed at a predetermined location in said each of said tapered stationary plate members adjacent an outer surface thereof;

(vii) a preselected second lubricating insert member disposed within said second elongated slot to provide at least a second portion of said requisite amount of lubrication necessary to prevent such detrimental sticking of said friction clutch mechanism after such closure of said friction clutch type draft gear assembly and during such release cycle thereof;

(viii) a pair of wedge shoe members having a Brinell Hardness of between 429 and 495, each of said wedge shoe members including (a) a tapered outer surface frictionally engaged with a respective said inner surface of said tapered stationary plate members for absorbing at least a third portion of such heat energy generated during such closure of said friction clutch type draft gear assembly, (b) an upper surface tapered from a point disposed inwardly from said tapered outer surface inwardly toward and at an acute angle relative to a longitudinal axis of said friction clutch mechanism, said tapered upper surface being tapered at an angle of between 46.5 degrees and 48.5 degrees, and (c) a bottom surface tapered from a point disposed inwardly from said tapered outer surface inwardly toward and at an acute angle relative perpendicularly to said longitudinal axis of said friction clutch mechanism, said tapered bottom surface being tapered at an angle of between 21.0 degrees and 22.00 degrees;

(ix) a third elongated slot formed at a predetermined location in said each of said wedge shoe members adjacent said tapered outer surface thereof;

(x) a preselected third lubricating insert member disposed within said third elongated slot to provide at least a third portion of said requisite amount of lubrication necessary to prevent such detrimental sticking of said friction clutch mechanism after such closure of said friction clutch type draft gear assembly and during such release cycle thereof; and (xi) a center wedge member, said center wedge member including a pair of correspondingly tapered surfaces frictionally engaged with an upper tapered surface of a respective one of said pair of wedge shoe members for absorbing at least a fourth portion of such heat energy generated during such closure of said friction clutch type draft gear assembly; and (d) a spring seat member engageable with one end of said compressible cushioning means and with said friction clutch mechanism for transmitting longitudinal forces to said compressible cushioning means from said friction clutch mechanism during closure of said friction clutch type draft gear assembly and from said compressible cushioning means to said friction clutch mechanism during such release cycle of said friction clutch type draft gear assembly, respectively.

10. An improved high capacity friction clutch type draft gear assembly, according to claim 9, wherein said compressible cushioning means at least includes a plurality of springs.

11. An improved high capacity friction clutch type draft gear assembly, according to claim 10, wherein an upper portion of said spring seat member includes a pair of tapered surfaces which frictionally engage said tapered bottom surface of said wedge shoe members, said frictionally engaging surfaces absorbing at least a fifth portion of such heat energy generated during such closure of said friction clutch type draft gear assembly.

12. An improved high capacity friction clutch type draft gear assembly, according to claim 9, wherein said tapered upper surface of said each of said wedge shoe members is tapered at an angle of substantially about 47.5 degrees.

13. An improved high capacity friction clutch type draft gear assembly, according to claim 12, wherein said tapered bottom surface of said each of said wedge shoe members is tapered at an angle of substantially about 21.5 degrees.

14. A method of increasing a capacity rating of a friction clutch type draft gear assembly during a reconditioning of such friction clutch type draft gear assembly, said method comprising the steps of:

(a) removing a friction clutch mechanism from an open end of a housing member of said friction clutch type draft gear assembly;

(b) engaging a respective outer surface of a pair of outer stationary plate members with respective radially opposed portions of an inner surface of said housing member adjacent said open end of said housing member, said outer stationary plate members having a Brinell Hardness of between 429 and 495;

(c) frictionally engaging at least a predetermined portion of a respective outer surface of a pair of movable plate members with a respective radially opposed inner surface of said outer stationary plate members;

(d) frictionally engaging a respective outer surface of a pair of inner stationary plate members with at least a portion of a respective radially opposed inner surface of said movable plate members;

(e) providing a predetermined taper on an inner surface of each of said pair of inner stationary plate members, said taper extending upwardly from a bottom surface thereof and outwardly from a longitudinal centerline of said friction clutch type draft gear assembly;

(f) frictionally engaging a respective outer tapered surface of a pair of wedge shoe members with a respective inner tapered surface of said tapered stationary plate members, said wedge shoe members having a Brinell Hardness of between 429 and 495;

(g) providing a tapered upper surface on each of said pair of wedge shoe members, said tapered upper surface tapering from a point disposed inwardly from said tapered outer surface inwardly toward and at an acute angle relative said longitudinal centerline of said friction clutch type draft gear assembly, said tapered upper surface being tapered at an angle of between 46.5 degrees and 48.5 degrees;

(h) providing a tapered bottom surface on said each of said pair of wedge shoe members, said tapered bottom surface tapering from a point disposed inwardly from said tapered outer surface inwardly toward and at an acute angle relative perpendicularly to said longitudinal centerline of said friction clutch type draft gear assembly, said tapered bottom surface being tapered at an angle of between 21.00 degrees and 22.00 degrees; and (i) frictionally engaging a pair of tapered surfaces disposed on a center wedge member with a respective tapered upper surface of said pair of wedge shoe members.

15. A method of increasing a capacity rating of a friction clutch type draft gear assembly during reconditioning, according to claim 14, wherein said method includes the additional steps of removing and inspecting a compressible cushioning element disposed in a closed end of said housing member and replacing it when necessary.

16. A method of increasing a capacity rating of a friction clutch type draft gear assembly during reconditioning, according to claim 15, wherein said method includes the additional step of examining said housing member for cracks and possible other wear defects after removing said friction clutch mechanism.

* * * * *

UNITED STATES PATENT AND TRADEMARK OFFICE

CERTIFICATE OF CORRECTION

PATENT NO. : 5,590,797

DATED : January 7, 1997

INVENTOR(S) : JAMES L. DUFFY, ET AL.

It is certified that error appears in the above-identified patent and that said Letters Patent is hereby corrected as shown below:

Column 2, line 54, after "frictionally" please delete "engaged" and insert --engage--.
Column 5, line 16, after "members" please delete "ia" and insert --is--.
Column 6, line 36, after "gear" please delete "manufactures" and insert --manufacturers--;
column 6, line 57, after "is" please insert --a--.
Column 9, line 37, after "as" please delete "possibly" and insert --possible--.
Column 11, line 38, please delete "or" and insert --for--.
Column 12, line 40, after "Hardness", please insert --in a range--.

Signed and Sealed this

Fourth Day of January, 2000

*Attest:*

*Attesting Officer*

*Acting Commissioner of Patents and Trademarks*